US006857298B2

(12) United States Patent
Linares

(10) Patent No.: US 6,857,298 B2
(45) Date of Patent: Feb. 22, 2005

(54) DOUBLE ACTION PUSH BUTTON LOCKING SYSTEM

(75) Inventor: Rodolfo Linares, Whittier, CA (US)

(73) Assignee: S.P.E.P. Acquisition Corporation, Rancho Dominquez, CA (US)

( * ) Notice: Subject to any disclaimer, the term of this patent is extended or adjusted under 35 U.S.C. 154(b) by 0 days.

(21) Appl. No.: 10/330,768

(22) Filed: Dec. 27, 2002

(65) Prior Publication Data

US 2004/0123636 A1 Jul. 1, 2004

(51) Int. Cl.[7] ..... B65D 55/14

(52) U.S. Cl. ..... 70/159; 292/DIG. 37; 70/162; 70/169

(58) Field of Search ..... 70/159, 162, 169, 70/173; 292/DIG. 37

(56) References Cited

U.S. PATENT DOCUMENTS 5,235,830 A * 8/1993 Benge ..... 70/56
5,308,126 A * 5/1994 Weger et al. ..... 292/53
5,484,092 A * 1/1996 Cheney ..... 224/404
5,700,056 A * 12/1997 Bernard ..... 297/378.13
5,823,411 A * 10/1998 Gronwoldt et al. ..... 224/328
5,875,948 A * 3/1999 Sadler ..... 224/404
6,151,933 A * 11/2000 Lentini ..... 70/159
6,231,091 B1 * 5/2001 Gleason et al. ..... 292/34
6,349,577 B1 * 2/2002 Hansen et al. ..... 70/159
6,564,602 B2 * 5/2003 Gregory ..... 70/360

* cited by examiner

*Primary Examiner*—John B. Walsh
(74) *Attorney, Agent, or Firm*—Christie, Parker & Hale, LLP

(57) ABSTRACT

Locking systems for containers with closures. The locking systems have latches with a single actuator rod connected thereto. Locks are also provided. Opening the locks move the actuator rod. The latches can preferably be rotary latches, and the locks can be paddle handles connected to the latches or push button locks that move the actuator rod.

7 Claims, 15 Drawing Sheets

DOUBLE ACTION PUSH BUTTON LOCKING SYSTEM

BACKGROUND OF THE INVENTION

As concern about security rises, so too does the prevalence of lock use. While locks can help deter theft and vandalism, it is important to reduce the inconvenience of using locks to the greatest extent possible, so that the locks will be consistently used.

Many types of containers, including cabinets, boxes, and tool chests have movable closures (e.g. lids and doors). For added security, locking systems are used to prevent unauthorized opening of these containers. One important application of locks has been in their use in pickup truck bed boxes, which are placed between the sidewalls of the pickup's bed adjacent to the cab. Locking bed boxes have been around for many years, and comprise a container with at least one cover. Older designs used two covers accessible from right and left sides of the truck. In these older pickup truck bed box designs, separate key locks controlled access to the left and right sides of the box and connection between the two was not needed. More recent designs for pickup truck bed boxes include a single cover which is hinged to the rear of the single box. Locks are located either on the left and right side walls of the box (e.g. push button locks) or on the left and right front sides of the box (e.g. paddle handle locks), and these locks operate at least one and more often two latches that are mounted inside the box. These locks are connected to the latches in such a manner that a user can open the cover from either the left or right side of the box without having to unlock the locks on both the left and right sides of the box. The latches are used to secure the lid to the box when the lid is closed. Rotary style latches, bayonet style latches and other types of latches can be used, with rotary style latches typically providing better tamper resistance than bayonet style latches. In order to be able to open pairs of existing rotary style and bayonet style latches by opening either a single push button lock or a single paddle handle, linking structures and mechanism must be provided. These linking structures and mechanism can comprise multiple actuator rods and direction reversing mechanisms, all of which add to the parts and assembly costs.

There accordingly remains a need for locking systems for containers that provide for maximum security yet have lower parts and assembly costs regardless of the precise storage container and closure the locking system is used with.

SUMMARY OF THE INVENTION

The invention is a locking system for containers that can be used with a single actuator rod and without direction turning apparatuses.

In one embodiment, the locking system comprises:

at least two latches;

at least two locks; and an actuator rod connecting the at least two latches, wherein if at least one lock is unlocked, opening the at least one lock connected to one latch will move the actuator rod and open the at least two latches.

In another embodiment, the locking system comprises:

at least two rotary latches;

at least two paddle handles that are connected to the at least two rotary latches, the paddle handles being affixed to the container;

at least two locking bars fixed to the closure; and an actuator rod connecting the at least two rotary latches, wherein if neither paddle handles is locked, opening one of the paddle locks will move the actuator rod in a first lateral direction and open the at least two rotary latches.

In a further embodiment, the locking system comprises:

at least one latch;

two push button locks affixed at opposing sides of a container, each push button lock have a housing, a push button, and a plunger button that is pushed out of the housing when the push button lock is unlocked and the push button is depressed, which plunger button can be pushed back into the housing when the push button lock is both locked and unlocked;

a locking bar fixed to the closure; and an actuator rod connected to the at least one latch and laterally positioned between the two plunger buttons of the two push button locks;

wherein if at least one of the two push button locks is unlocked, opening the at least one unlocked push button lock will move the actuator rod in a lateral direction and open the at least one latch.

In yet another embodiment, the locking system comprises:

at least two rotary latches;

at least two locks engaged with the at least two rotary latches;

at least two locking bars;

a single, straight actuator rod connecting the at least two rotary latches, wherein if at least one lock is unlocked, opening the at least one unlocked lock connected to one rotary latch will move the actuator rod and open the at least two rotary latches.

In yet a further embodiment, the locking system comprises:

at least two latches;

at least one push button lock that is affixed to the container, the push button lock have a housing, a push button, and a plunger button that is pushed out of the housing when the push button lock is unlocked and the push button is depressed but will not be pushed out of the housing when the push button lock is locked;

a locking bar affixed to the closure; and a single, actuator rod connecting the at least two latches, and having an end in the vicinity of the push button lock wherein if the lock is unlocked, opening the unlocked lock will move the actuator rod in a first lateral direction and open the at least two latches.

In still a further embodiment, the locking system comprises:

at least two latches;

at least one push button lock that is affixed to the container, the push button lock have a housing, a push button, and a plunger button that is pushed out of the housing when the push button lock is unlocked and the push button is depressed but will not be pushed out of the housing when the push button lock is locked;

a locking bar fixed to the closure; and a single, actuator rod connecting the at least two latches, and having an end in the vicinity of the push button lock wherein if the lock is unlocked, opening the unlocked lock will move the actuator rod in a first lateral direction and open the at least two latches.

DETAILED DESCRIPTION OF THE INVENTION

Figure 1:
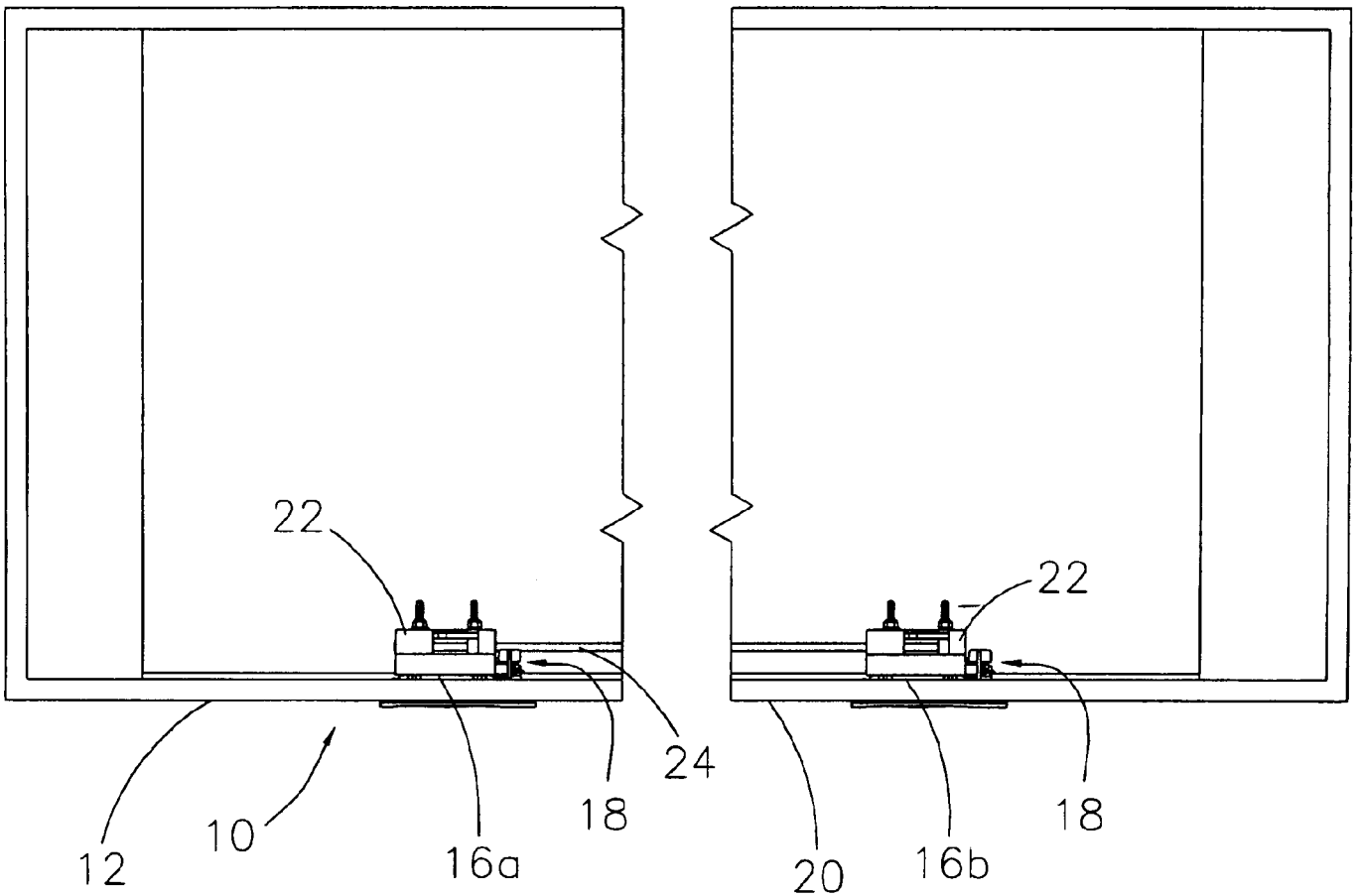
FIG. 1 is a top perspective view of an embodiment of the locking system of the invention wherein two paddle handles are located on a container (with its lid not shown) and two rotary latches are located inside the container and are operatively connected to the paddle handles and to each other by an actuator rod.
Figure 2A:
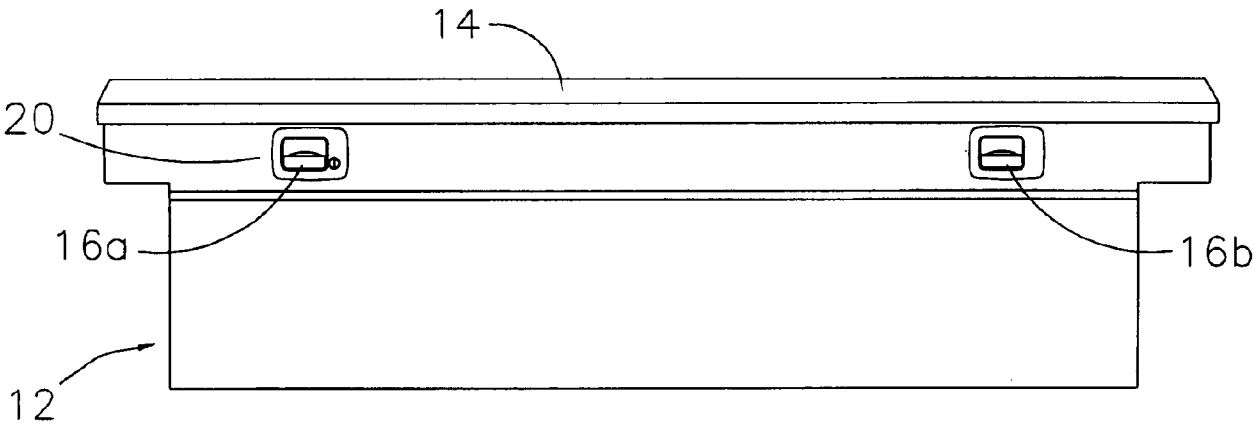
FIG. 2A is a front plan view of a container of FIG. 1 with two paddle handles attached thereto with its lid shown in the closed position.
Figure 2B:
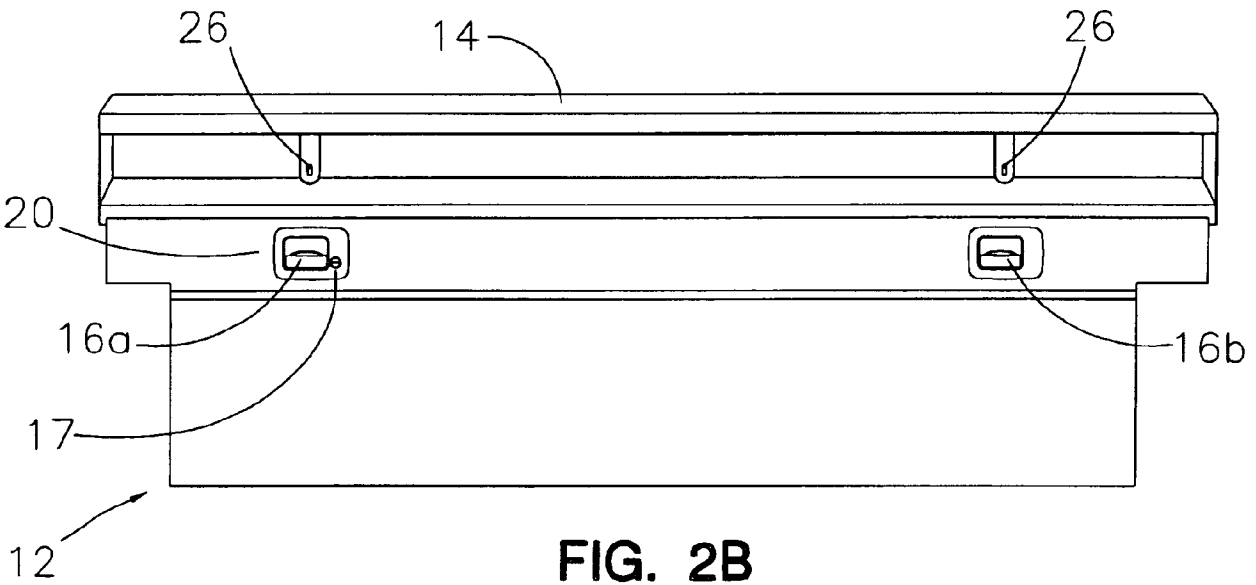
FIG. 2B is a front plan view of a container of FIG. 1 with two paddle handles attached thereto with its lid shown in the opened position.

Turning to FIGS. 1, 2A and 2B, there are shown views of an embodiment of the locking system 10 constructed in accordance with the invention attached to an exemplary container 12 with a closure or lid 14 which may be hinged to container 12. The locking system 10 can be used with other containers and closures, such as cabinets with doors and on doors to rooms and the like. The locking system 10 has at least two paddle handles 16 positioned within apertures 18 at a wall 20 of container 12. Each paddle handle 16 is connected to a rotary latch 22 (or other type of latch) such that the action of moving the unlocked paddle handle to its opened position causes the rotary latch to open. Rotary latches 22 are operatively connected together with an actuator rod or bar 24. Closure 14 has locking bars 26 for engaging with rotary latches 22. As shown in FIGS. 2A and 2B, one paddle handle, e.g. 16*a* can be equipped with a cylinder lock 17, and the other paddle handle 16*b* need not have a cylinder lock. In this embodiment, paddle handle 16*a* with cylinder lock 17 can be located on a side more accessible to the user, e.g. on the driver's side of the truck. In operation, if only paddle handle 16*a* locks or both paddle handles 16 are unlocked, operating that unlocked paddle lock will cause not only that paddle lock's attached rotary lock to open, but will also cause the actuator rod 24 to slide to one direction, and thereby open the other rotary lock. This permits a user to open the closure of a container by actuating either unlocked paddle handles 16*a* or 16*b*. In the environment of bed mounted tool boxes, this allows a user to open a tool box by only being concerned with a single cylinder lock 17 (e.g. while standing on the driver's side of the truck bed.)

It is possible to use a single, locking paddle handle that is connected to and activates one rotary latch, and have that connected rotary latch activate an activation rod which controls another rotary latch. In this way, on single, locking paddle handle can be used to control two or even more rotary latches.

Figure 3:
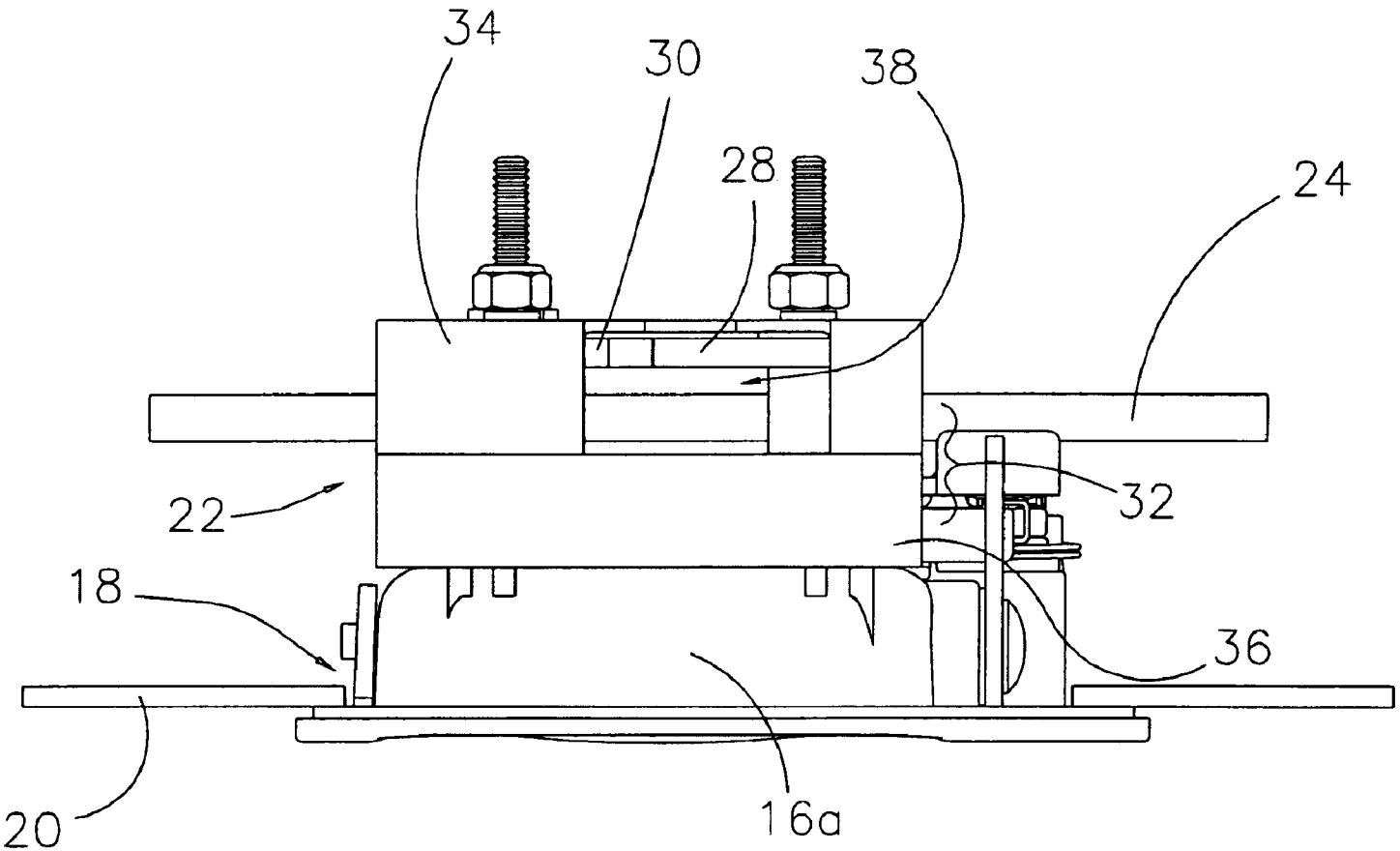
FIG. 3 is a top plan view showing one of the rotary latches and paddle handles of FIG. 1, with a section of the actuator rod connected thereto, and attached to a section of the container wall.

FIG. 3 is a top plan view showing an exemplary paddle handle 16*a* retained in aperture 18 of wall 20 of container. Paddle lock 16*a* is operatively connected to rotary lock 22 so that activation of unlocked paddle handle 16*a* will open rotary lock 22. A section of actuator rod 24, as is a portion of a strike 28 and a catch 30 which holds strike in its locked position, are shown. Strike 28 is rotatably mounted within a latch enclosure 32 made up of a cover 34 and a base 36. Cover 34 has an opening 38 through which strike 28 is accessible to locking bar 26 (not shown).

Figure 4:
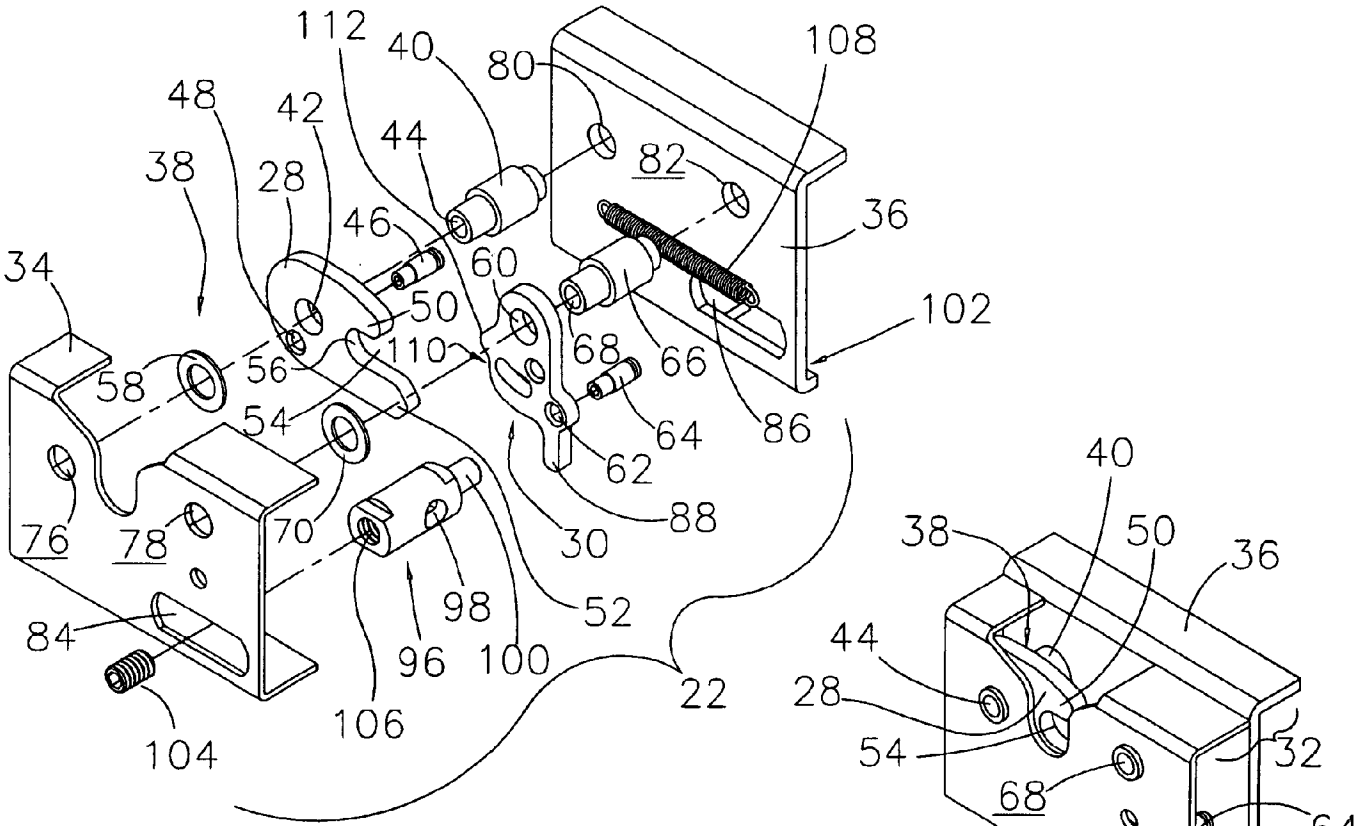
FIG. 4 is an exploded perspective view of a single action embodiment of a rotary latch used for the locking system.
Figure 10:
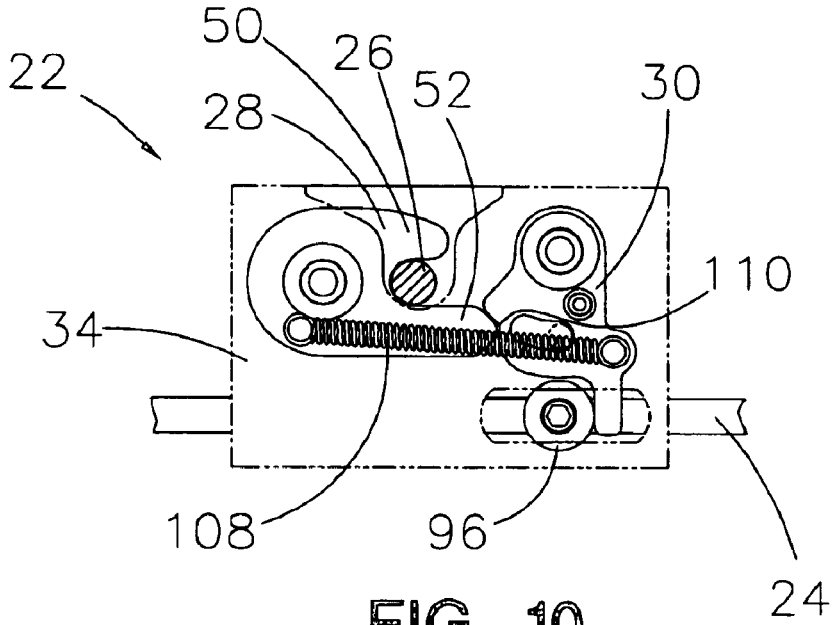
FIG. 10 is a front plan view of the rotary latch of FIG. 5 showing various parts exposed.

FIG. 4 is an exploded perspective view of rotary latch 22, and shows its component parts. Catch 28 is pivotally mounted to cover 34 and base 36 with a strike retainer 40 which passes through a pivot hole 42. Strike pivot 40 may have a through hole 44 formed therein. A spring pin 46 is fixed to strike 28. Spring pin 46 can be press fit into a hole 48 formed in strike 28. Strike 28 has a thumb portion 50 and a finger portion 52, with a recess 54 located therebetween with a curved base 56, with recess 54 being sized and shaped to receive locking bar 26 therein (as shown in FIG. 10). Finger 52 of strike 28 preferably has a rounded or non-square end. A washer 58 can be provided between strike 28 and cover 34. Catch 30 has a catch pivot hole 60, and a hole 62 formed therethrough for receiving a spring pin 64. Catch pivot hole 60 is used for pivotally retaining catch 30 on a catch pivot 66, which may have a through hole 68 formed therein. A catch washer 70 can be provided between catch 30 and cover 34. Cover 34 has holes 76 and 78 formed therein and base 36 has aligned holes 80 and 82 formed therein, holes 76 and 80 being for receipt of strike pivot 40 and holes 78 and 82 being for receipt of pivot retainer 66. Cover 34 has an elongate slot 84 formed therein and base 36 has a matching elongate slot 86 formed therein. Catch 30 has a finger 88 at a lower end. An actuator 96 is provided that slides in elongate slots 84 and 86. Actuator 96 has an actuator rod receiving hole 98 therein, and an inner end 100 which protrudes through elongate slot 86 and which is adapted to engage with a lever of a paddle handle, as will be further described below. Base 36 may have a cutout 102 formed near where inner end 100 protrudes through base 36. A retainer screw 104 may be provided to screw into a threaded hole 106 in actuator to lock actuator rod (not shown) in place to actuator. This arrangement provides a simple and reliable way to connect the actuator rod to the actuator. However, other means can be used to lock actuator rod in place to actuator. A spring 108 is provided, and is stretched between and attached to spring pin 46 attached to strike 28 and catch pin 64 attached to catch 30, and biases them together. In lieu of pins 46 and 64 on strike 28 and catch 30, respectively, as attachment points for the ends of spring 108, portions of strike 28 and catch 30 can be bent up as spring attachment points. Catch 30 has a mouth region 110 which is sized and shape to retain end of finger 52, and a convexly rounded nose region 112 above mouth region 110.

Figure 5:
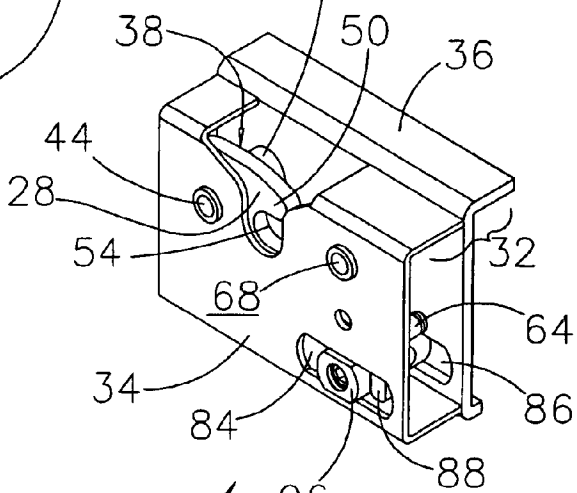
FIG. 5 is a front perspective view of the parts of the rotary latch of FIG. 4 in an assembled state.

FIG. 5 is a front perspective view of the completely assembled rotary latch 22 with its strike in the closed position relative to opening 38 in cover 34 of latch enclosure 32, with finger 88 of catch 30 resting on a right side of actuator 96. As can be appreciated, movement of actuator 96 to the right will push on finger 88 of catch 30 and swing catch 30 on its pivot 66 away from strike 28 so that mouth 110 is moved away from finger 52 of strike, and the pulling force of spring 108 will then cause catch to rotate up. Through holes 44 and 68 are shown.

Figure 6:
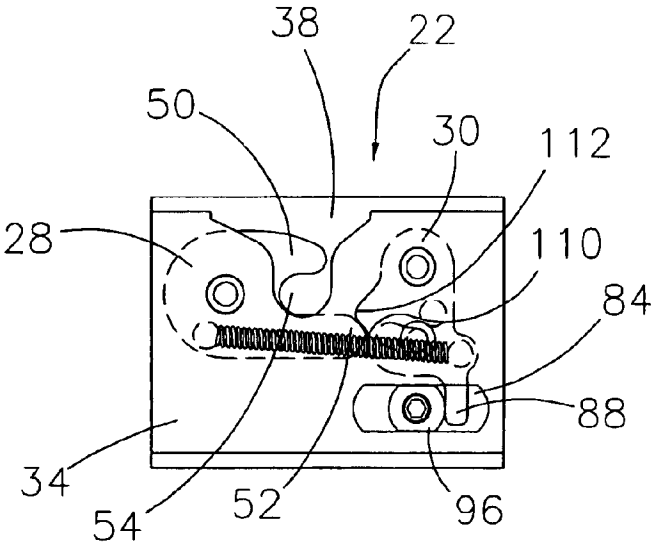
FIG. 6 is a front plan view of the rotary latch of FIG. 5 in its locked position showing outlines of various parts in phantom.

FIG. 6 is a front plan view of the rotary latch 22 of FIG. 5 in its locked position showing outlines of various parts in phantom. Strike 28 is in the closed position relative to opening 38 in cover 34, with finger 52 of strike 28 resting in mouth 110 of catch 30 below nose 112, and with thumb 50 and finger 52 being in a generally horizontal orientation where recess 54 will be captured within opening 38 of cover 34 which will lock a locking bar (not shown) in place and prevent it from being pried out. Finger 88 of catch 30 rests on right side of actuator 96.

Figure 7:
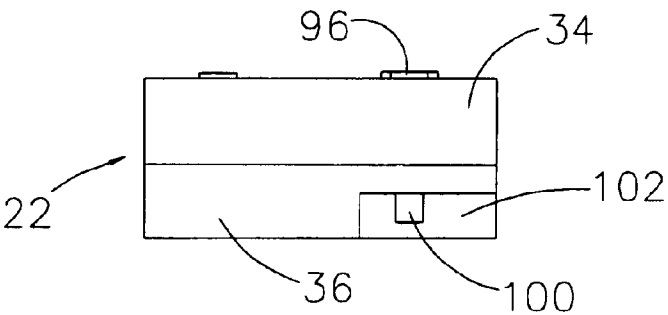
FIG. 7 is a bottom view of the rotary latch of FIG. 5.

FIG. 7 is a bottom view of rotary latch 22 and reveals inner end 100 of actuator 96 through cutout 102 of base 36. A portion of actuator is also shown extending through cover 34.

Figure 8:
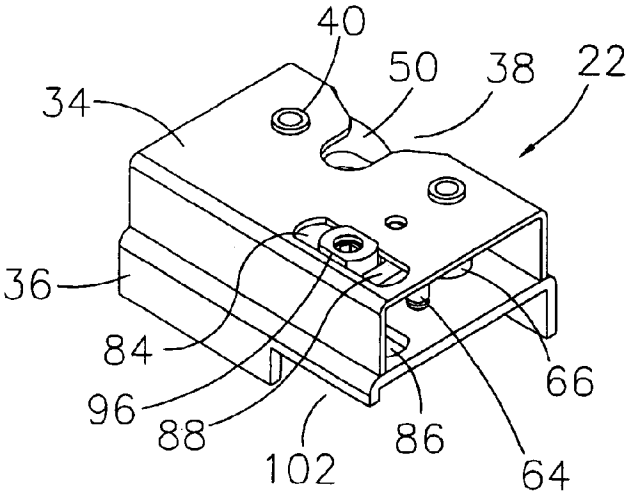
FIG. 8 is a bottom perspective view of the rotary latch of FIG. 5.

FIG. 8 is a bottom perspective view of rotary lock 22 in its locked position.

Figure 9:
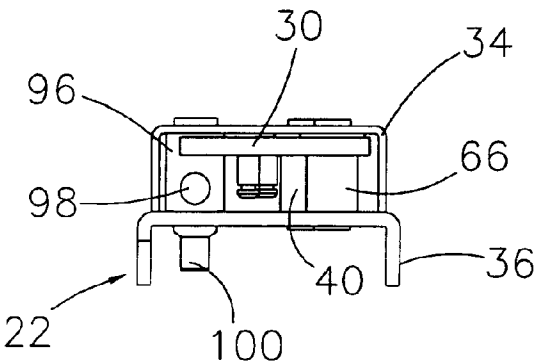
FIG. 9 is a right side view of the rotary latch of FIG. 5.

FIG. 9 is a right side view of the rotary latch 22 without its spring attached and shows actuator rod receiving hole 98 formed through actuator 96, with inner end 100 extending through base 36. Catch 30, cover 34, strike retainer 40 and catch pivot 66 are also shown.

FIG. 10 is a front plan view of rotary latch 22 in its locked position with cover 34 shown in phantom and showing rotary lock 22 with a section of actuator rod 24 attached to actuator 96. Finger 52 of strike 28 is shown being captured in recess 110 of catch 30, with spring 108 retaining strike 28 and catch 30 together. Locking bar 26 is shown captured between finger 52 and thumb 50 of strike 28.

Figure 11:
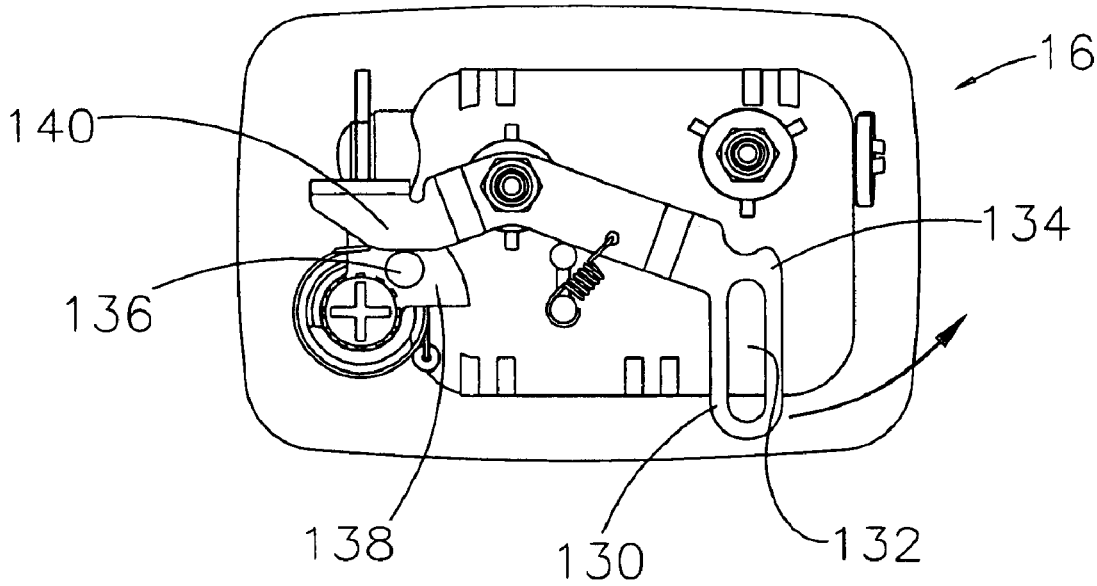
FIG. 11 is a back view of a representative paddle handle showing its lever.

FIG. 11 is a back view of an exemplary paddle handle 16*a* having a cylinder lock (not shown). Paddle handle 16*a* has a moveable lever 130, which lever 130 will move in the direction of the arrow upon being operated. Such an exemplary paddle handle is disclosed and described in the inventor's co-pending patent application Ser. No. 10/277,522, entitled "Paddle Lock", filed on Oct. 22, 2002, the contents of which are incorporated by reference. Lever 130 has a slot 132 formed at a latch engaging end 134. The inner end 100 of actuator 96 is adapted to be received in slot 132 so the lever 130 and actuator 96 can only move together. A protrusion 136 is formed on a lock cam 138. When paddle handle 16*a* is locked, protrusion 136 will prevent a cam end 140 of lever 130 from moving, and thereby prevent latch engaging end 134 of lever 130 from moving the actuator connected thereto (not shown) from moving. Since the two actuators of the two rotary latches are connected to a single actuator rod, this prevent either actuator from being moved if even one of the paddle handles is locked.

Figure 12:
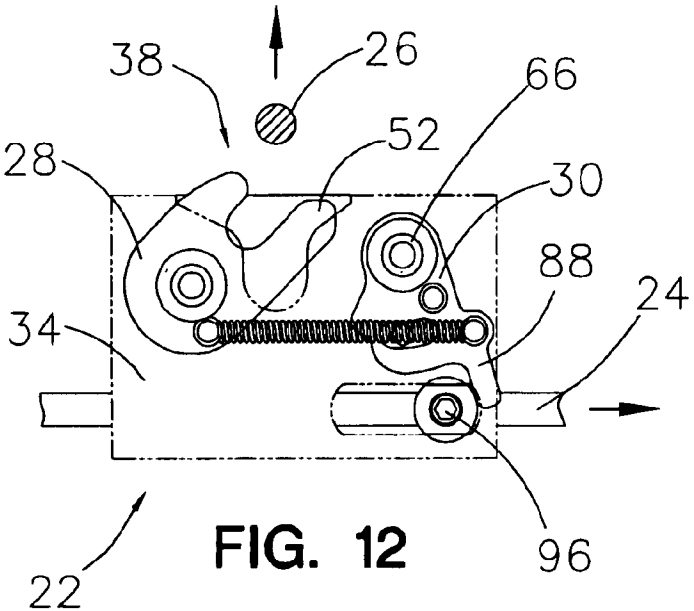
FIG. 12 is a front plan view of the rotary latch of FIG. 5 in its unlocked position with the actuator rod moved and with a closure bar being released.

FIG. 12 is a front plan view of rotary latch 22 in its unlocked position showing cover 34 in phantom with closure bar 26 being released and with actuator rod 24 moved such that its carried actuator 96 will push against finger 88 of catch causing catch 30 to move on catch pivot 66. This action moves catch 30 away from strike 28 and permits strike to rotate so that its finger 52 points up outside of opening 38 to release locking bar 26.

Figure 13:
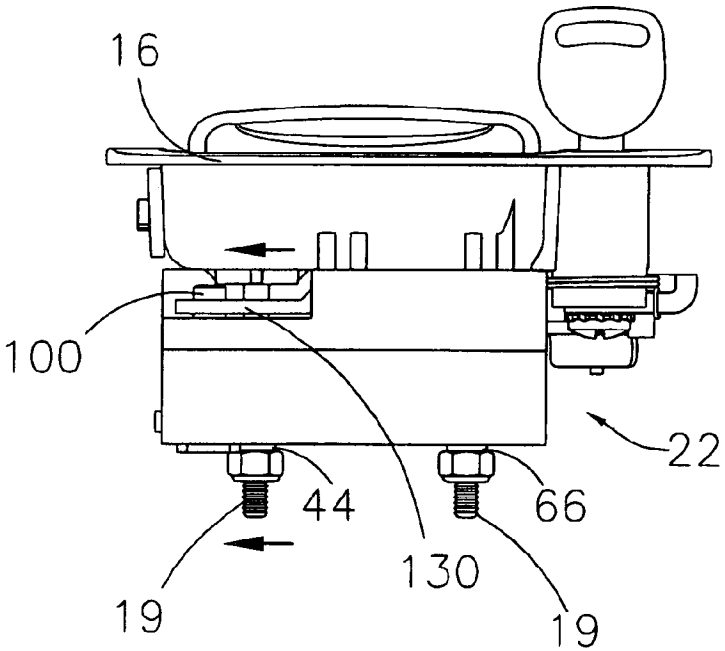
FIG. 13 is a bottom plan view showing a representative paddle handle and its lever moving an actuator of the rotary latch to open the rotary latch.

FIG. 13 is a bottom plan view showing the exemplary paddle lock 16 having its lever 130 moving actuator 96 of rotary latch 22 to open rotary latch 22. Bolts 19 are shown passing through through-holes 44 and 66, and inner end 100 of actuator is shown engaged with lever 130.

Figure 14:
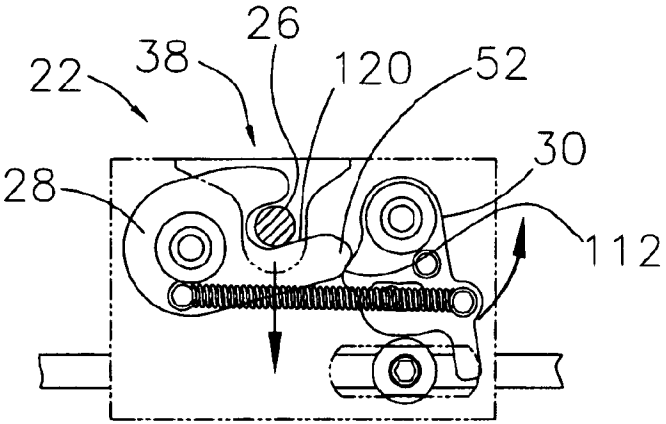
FIG. 14 is a front plan view of the rotary latch of FIG. 5 with a closure bar pushing the strike to its locked position with the catch.

FIG. 14 is a front plan view of rotary lock 22 being moved to its locked position with closure bar 26 being moved down against an inside edge 120 of finger 52 of strike 28. This action moves strike 28 downwardly and causes finger 52 to push on nose region 112 and causes catch 30 to pivot. Once closure bar 26 is pushed all the way down (as shown in FIG. 10), end of finger 52 seats in mouth region 110 of catch 30.

Although locking system 10 shows two paddle handles 16 attached to two rotary locks 22, it is possible to provide a single paddle handle which operates two or more rotary latches 22 connected together by an actuator rod. Also, the single or two paddle handles can be replaced with other types of locks that can activate and open the rotary latch. Indeed, the rotary latch can be replaced with other non-rotary types of latches in any of the embodiments shown herein.

Figure 15:
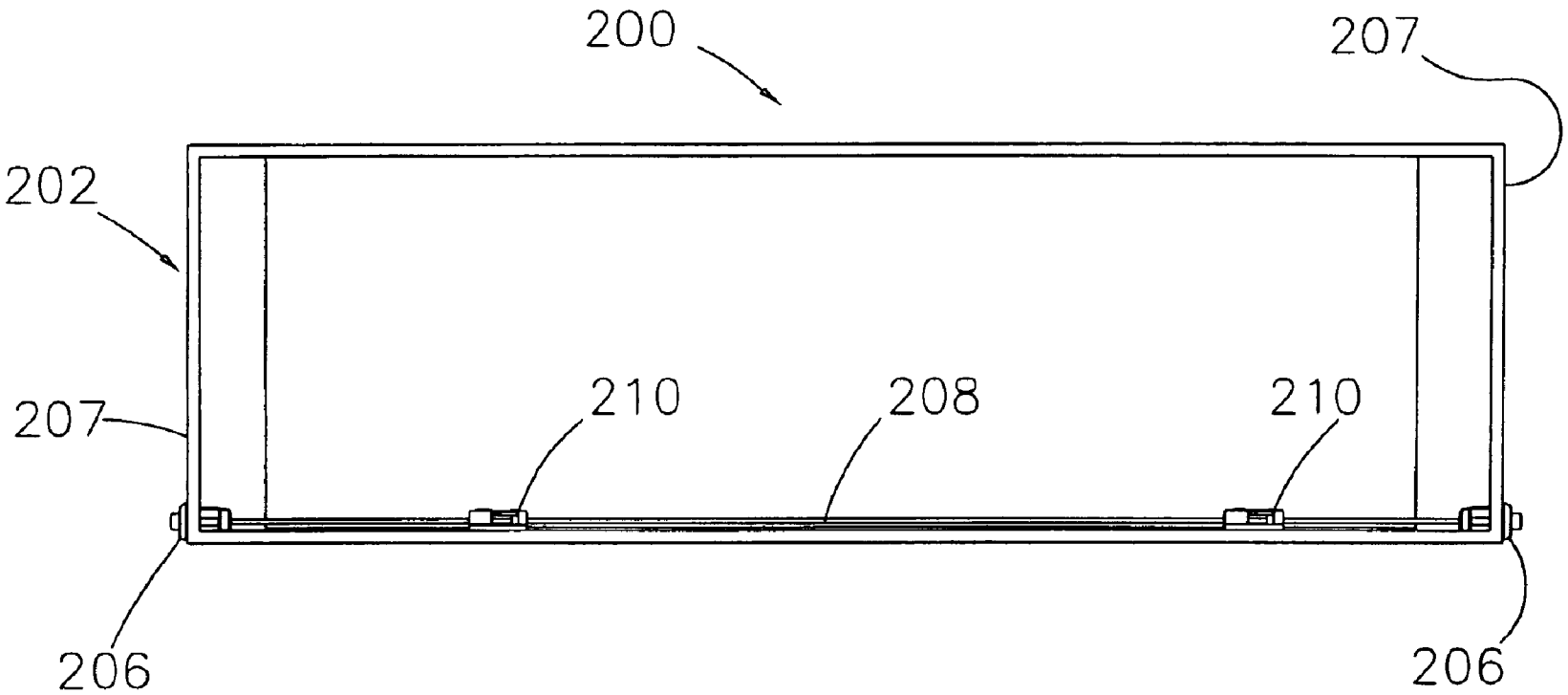
FIG. 15 is a top perspective view of another embodiment of the locking system of invention wherein two push button locks are located on a container and two rotary latches are located inside the container and are operatively connected to each other by a single actuator rod, which actuator rod is placed between the two push button locks.
Figure 16A:
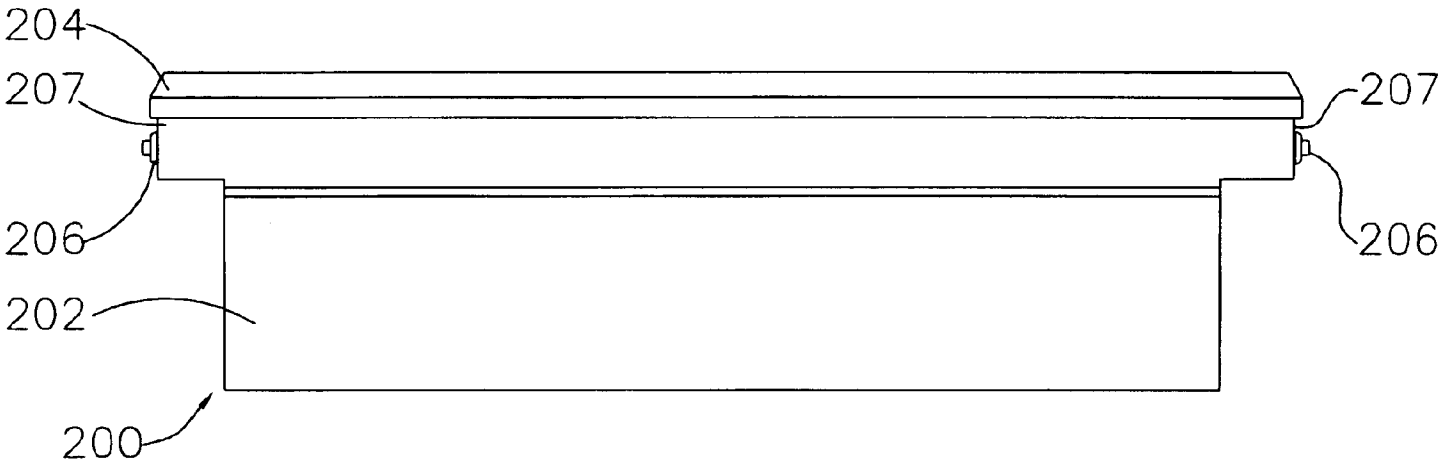
FIG. 16A is a front plan view of the embodiment of the invention with two push button locks attached to a container with its lid of FIG. 15 shown in the closed position.
Figure 16B:
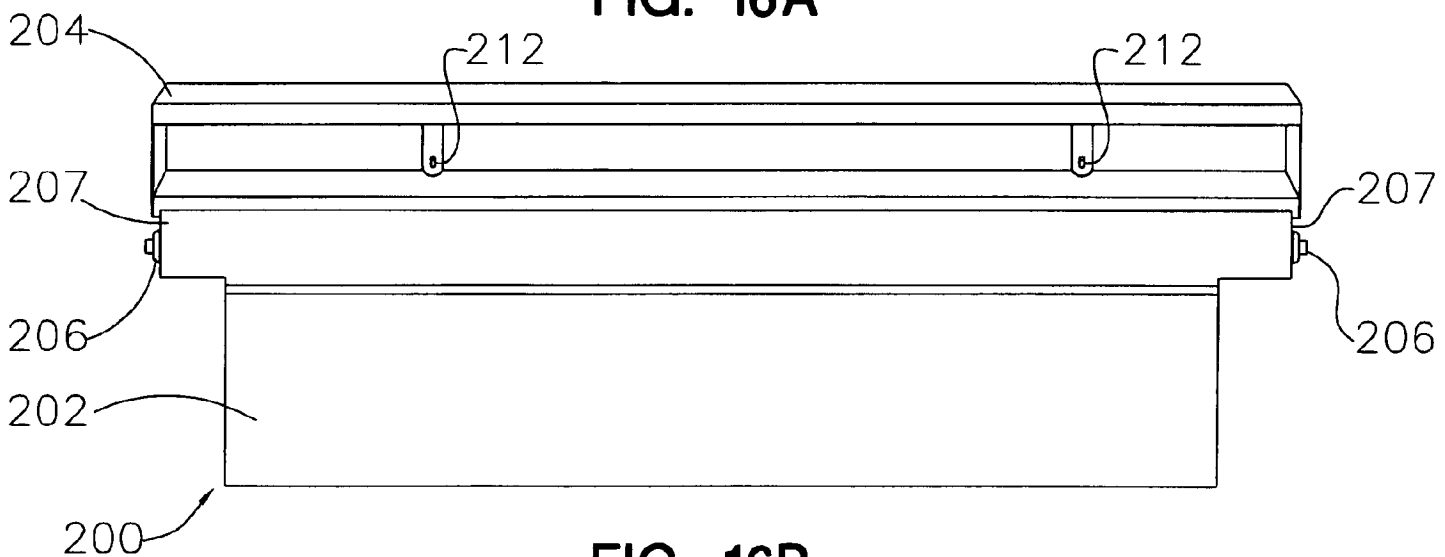
FIG. 16B is a front plan view of the embodiment of the invention of FIG. 15 with its lid shown in the opened position.

Turning now to FIGS. 15, 16A and 16B there are shown views of another embodiment of a locking system 200 constructed in accordance with the invention attached to an exemplary container 202 with a closure or lid 204 which may be hinged to container 202. The system 200 can be used with other containers and closures, such as cabinets with doors and the like. The locking system 200 has two push button locks 206 positioned within apertures formed on opposite side walls 207 of container 202. One such design for push button locks is described in the inventor's co-pending U.S. patent application entitled "PUSH BUTTON LOCK," which was filed on Nov. 4, 2002 (Serial Number not yet available), the contents of which are incorporated herein by reference. The push button locks 206 are adapted to push an actuator rod 208 that is connected to the double action rotary locks 210 fixed to container 202. Moving the actuator rod or bar 208 either to the left or right relative to the double action rotary locks 210 causes them to open. Closure 204 has locking bars 212 for engaging with double action rotary locks 210. In operation, if one or both of push button locks 206 are unlocked, operating the unlocked push button lock will push rod 208 to the left or to the right relative to double action rotary locks 210 and cause them to open. This permits a user to open the closure 204 of the container 202 even if only one of the two push button locks 206 are open. In the environment of a bed mounted tool box, this allows a user to open a tool box without needing to open both locks (e.g. while standing either to a left or right side of a truck's bed.)

Figure 17:
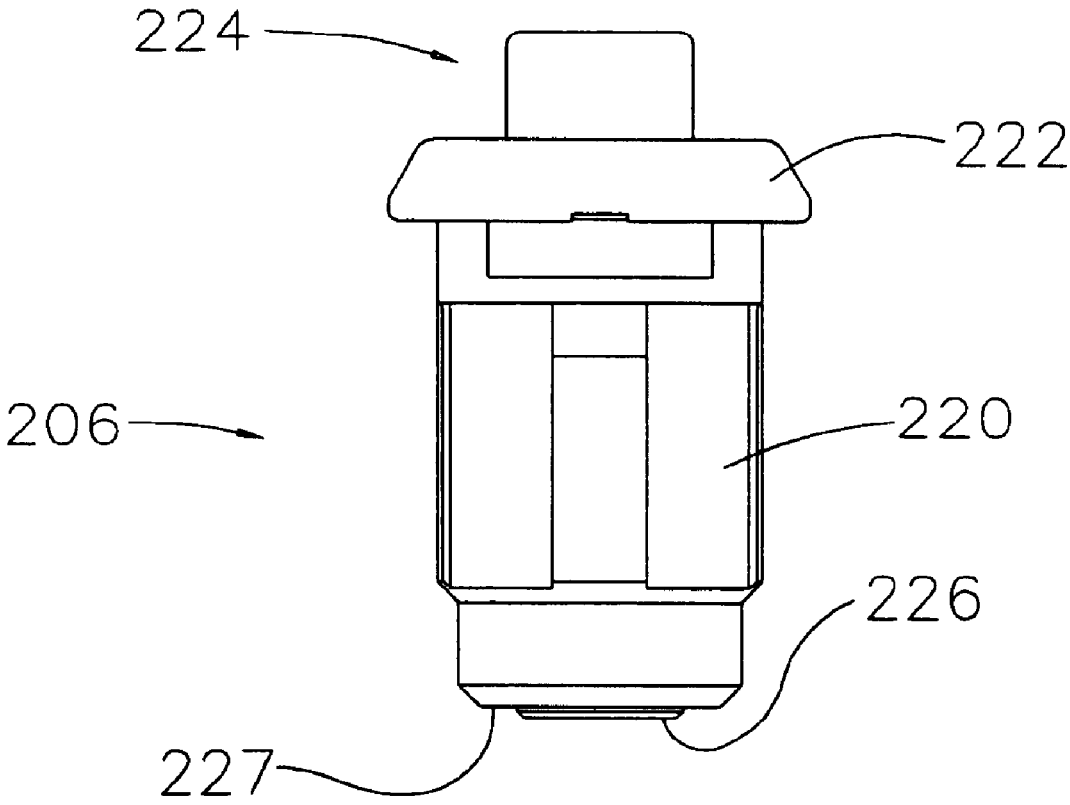
FIG. 17 is a side view of an exemplary push button lock used with the embodiment of the locking system of FIG. 15.

FIG. 17 is a side view of an exemplary push button lock 206 used in the embodiment 200 of the locking system of FIGS. 15, 16A and 16B. Push button lock 206 has a housing 220, a rim 222 which seats on container, a push button 224, and a plunger button 226 which can be pushed into an aperture in housing 220 or pushed out of housing 220 when plunger button 226 is depressed and is unlocked. When push button lock is in an unlocked position and its push button 224 is pushed, plunger button 226 will be forced out of housing beyond a terminal end 227 of housing 220. However, when push button lock is in a locked position and its push button 224 is pushed, plunger button 226 will not be moved out of housing, or if it is moved will not have sufficient driving force to move actuator rod.

Figure 18:
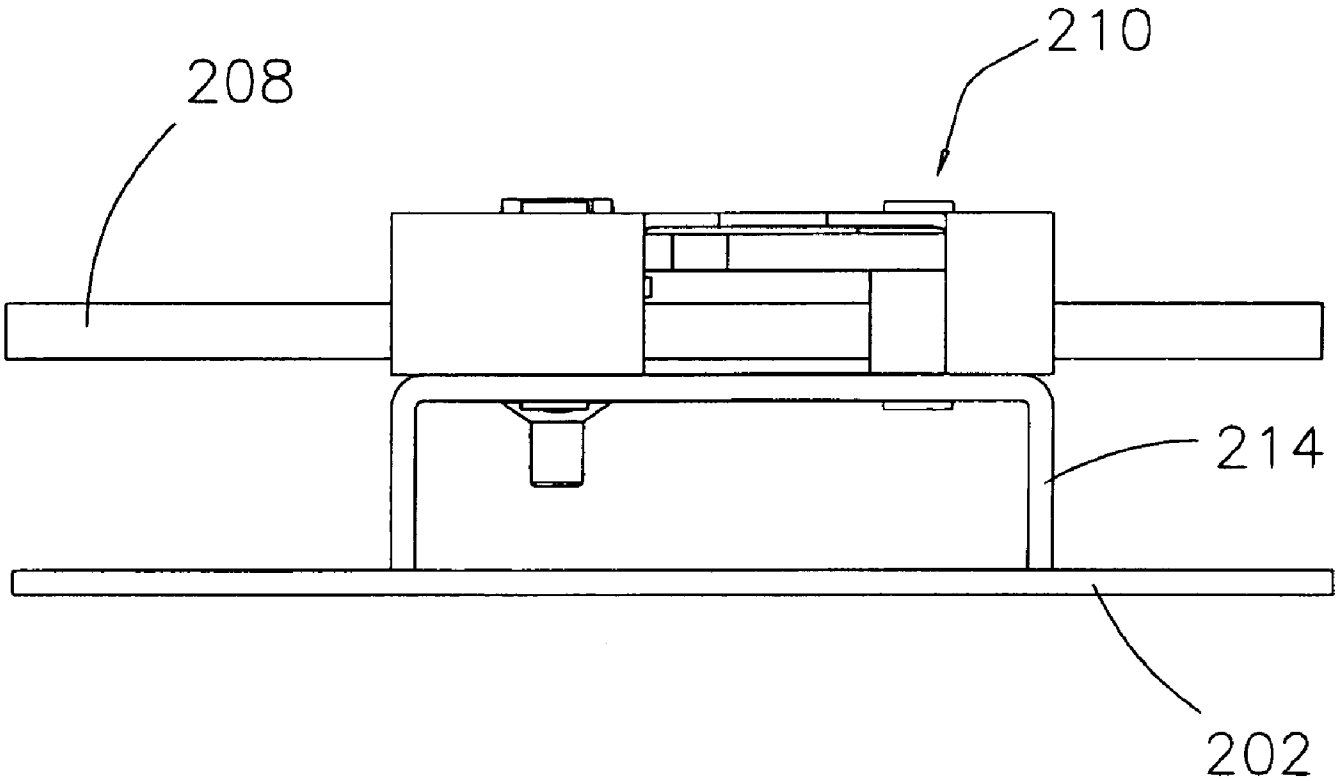
FIG. 18 is a top perspective view showing a rotary latch connected to a bracket connected to a section of a wall of the container, and showing a section of the actuator rod.

FIG. 18 is a top perspective view showing dual action rotary latch 210 attached to a bracket 214 fitted to container 202, and shows a section of actuator rod 208 connected to latch 210.

Figures 19, 20:
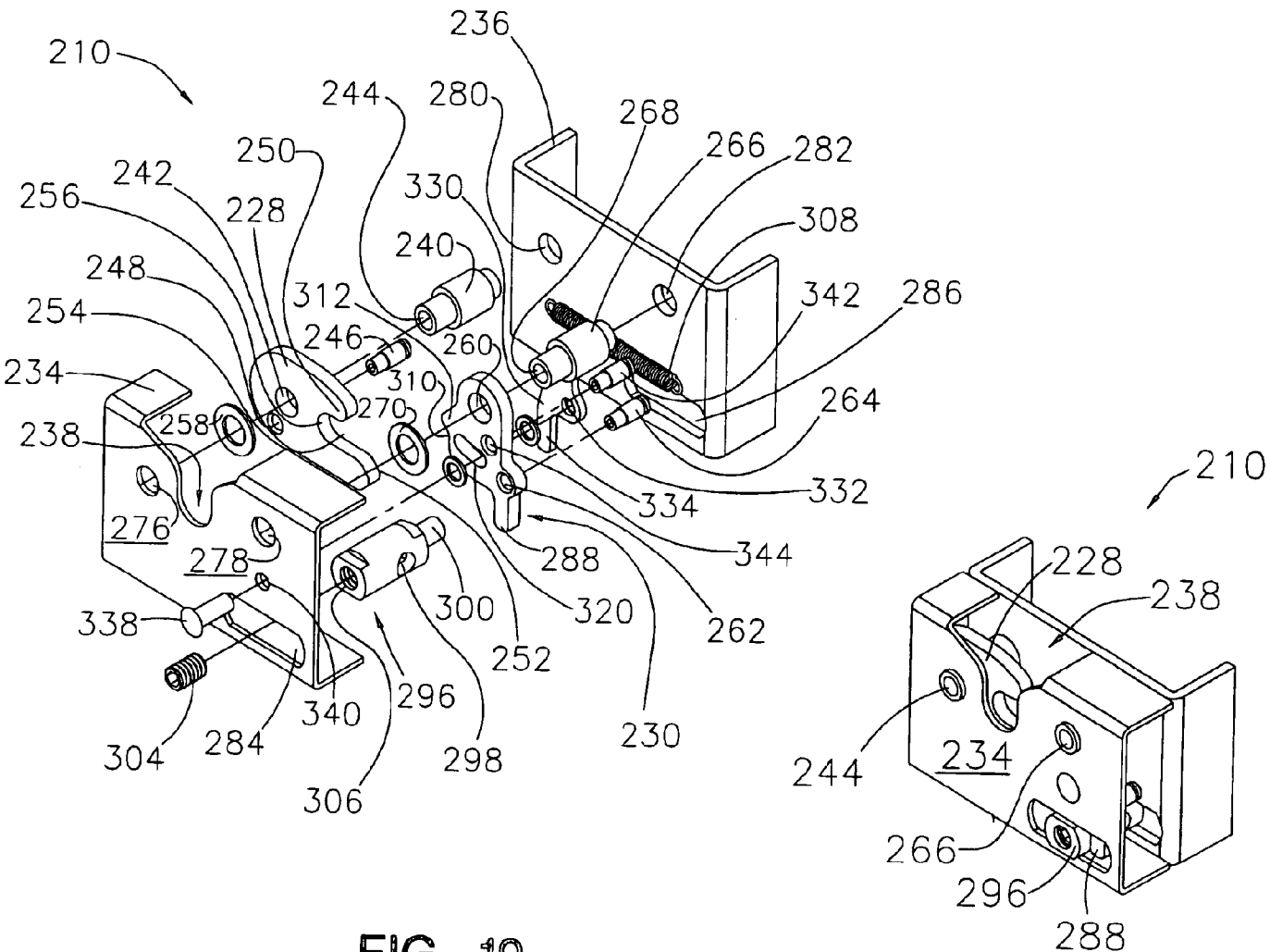
FIG. 19 is an exploded perspective view of a dual embodiment of a rotary latch used in locking the system of FIG. 15.
FIG. 20 is a front perspective view of the parts of the dual action rotary latch of FIG. 19 in an assembled state.
Figure 21:
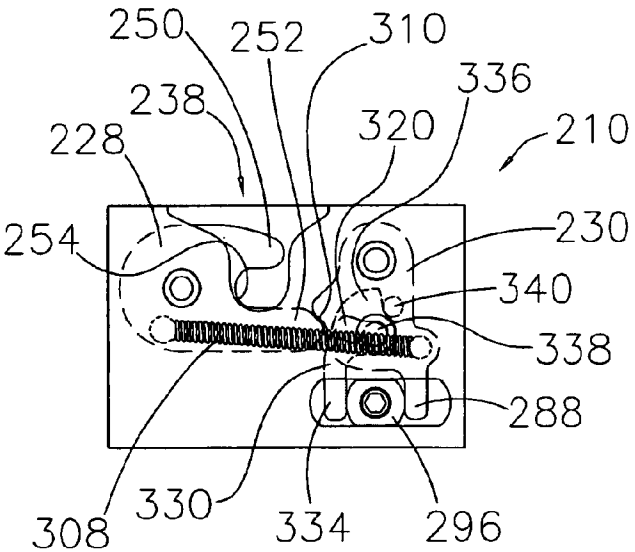
FIG. 21 is a front plan view of the dual action rotary latch of FIG. 20 in its locked position showing outlines of various parts in phantom.
Figure 25:
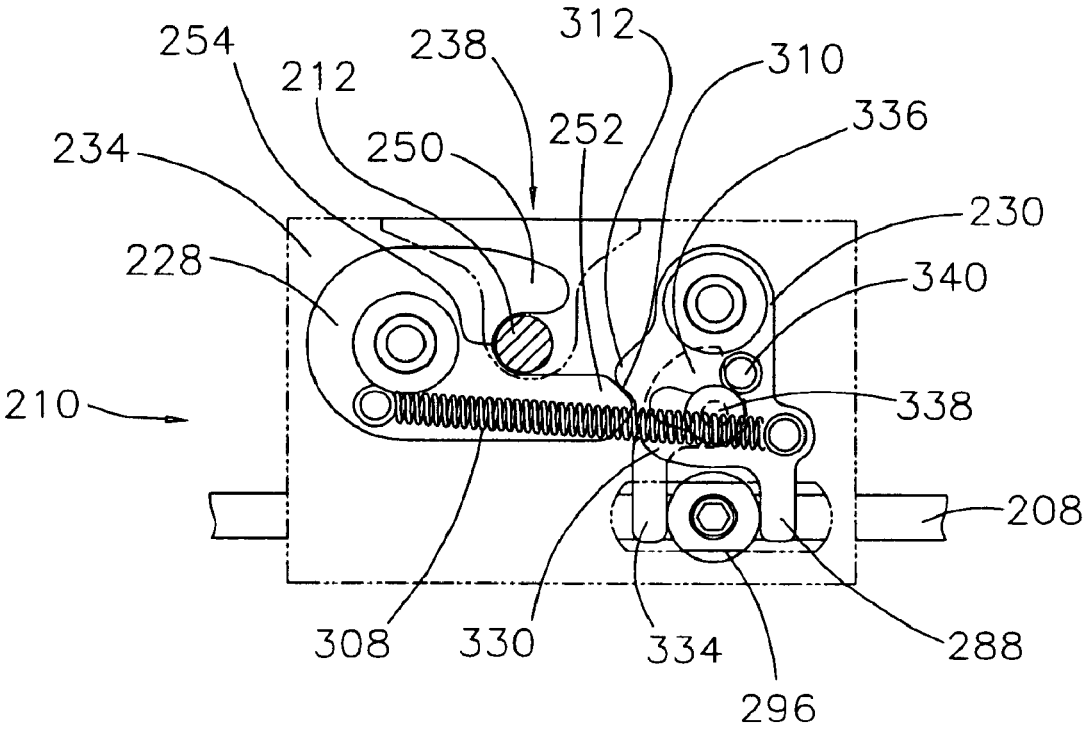
FIG. 25 is a front plan view of the dual action rotary latch of FIG. 20 showing outlines of various parts in phantom and in the locked position.

Turning to FIG. 19, it is an exploded perspective view of dual action rotary lock 210, and shows its component parts. Strike 228 is pivotally mounted to cover 234 and base 236 with a strike pivot 240 which passes through pivot hole 242. Cover 234 has an opening 238 formed therein. Strike pivot 240 may have a through hole 244 formed therein. A spring pin 246 is fixed to strike 228. Spring pin 246 can be press fit into a hole 248 formed in strike 228. Strike 228 has a thumb portion 250 and a finger portion 252, with a recess 254 therebetween with curved base 256, with recess 254 being sized and shaped to receive locking bar 212 therein (as shown in FIG. 25). Finger 252 of strike 228 preferably has a rounded or non-square end. A washer 258 can be provided between strike 228 and cover 234. A catch 230 has a catch pivot hole 260, and a hole 262 formed therethrough for receiving a pin 264. Catch pivot hole 260 is used for pivotally retaining catch 230 on a catch pivot 266, which may have a through hole 268 formed therein. A catch washer 270 can be provided between catch 230 and cover 234. Cover 234 has holes 276 and 278 formed therein and base 236 has aligned holes 280 and 282 formed therein, holes 276 and 280 being for receipt of strike pivot 240 and holes 278 and 282 being for receipt of catch pivot 266. Cover 234 has an elongate slot 284 formed therein and base 236 has a matching elongate slot 286 formed therein. Catch 230 has a finger 288 at a lower end. An actuator 296 is provided that slides in elongate slots 284 and 286. Actuator 296 has an actuator rod receiving hole 298 therein, and an inner end 300 which protrudes through elongate slot 286. A retainer screw 304 may be provided to screw into a threaded hole 306 in actuator 296 to lock actuator rod (not shown) in place. This arrangement provides a simple and reliable way to connect the actuator rod to the actuator. However, other means can be used to lock actuator rod in place to actuator. A spring 308 is provided, and is stretched between and attached to spring pin 246 attached to strike 228 and catch pin 264 attached to catch 230, and biases them together. In lieu of pins 246 and 264 on strike 228 and catch 230, respectively, as attachment points for the ends of spring 308, portions of strike 228 and catch 230 can be bent up as spring attachment points. Catch 230 has a mouth region 310 which is sized and shaped to retain rounded end of finger 252, and a convexly rounded nose region 312 above mouth region 310. Catch 230 has a slot 320 formed therein. So far, these parts can be the same as in the single action rotary latch embodiment shown in FIG. 5. The following are added parts which can be used to convert the single action rotary latch to a dual action rotary latch. A reverser 330 is provided and has a pivot hole 332 and a lower end 334. A riding end 336 is provided at an upper end of reverser 330 (as best shown in FIG. 21.) A pivot pin 338 passes through a pivot hole 340 in cover 234, passes through slot 320 in catch 230, and passes through pivot hole 332 of reverser 330. A second pin 342 is inserted into a pin hole 344 of catch 230.

FIG. 20 is a front perspective view of the completely assembled rotary latch 210 with its strike 228 in the closed position relative to opening 238 in cover 234, with finger 288 of catch 230 resting on a right side of actuator 296. Through holes 244 and 266 are shown.

FIG. 21 is a front plan view of the rotary latch 210 of FIG. 20 in its locked position showing strike 228 in the closed position relative to opening 238 in cover 234, with finger 252 of strike 228 resting in mouth 310 of catch 230, and with thumb 250 and finger 252 being in a generally horizontal orientation where recess 254 will be captured within opening 238 of cover 234 which will lock a locking bar (not shown) in place and prevent it from being pried out. Finger 288 of catch 230 rests on right side of actuator 296. Reverser 330 is shown pivoted with pivot pin 338 passing through slot 320 of catch 230. Lower end 334 of reverser 330 rides on left side of actuator 296, and riding end 336 rests on pin 340 on catch 230. Spring 308 tends to bias strike 228 and catch 230 together.

Figure 22:
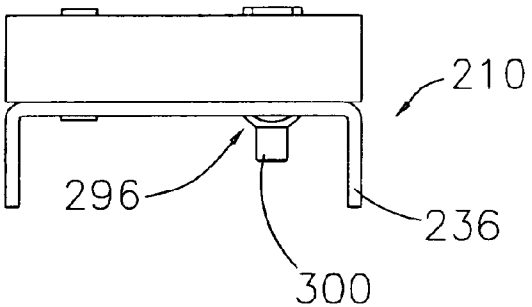
FIG. 22 is a bottom view of the dual action rotary latch of FIG. 20.

FIG. 22 is a bottom view of rotary lock 210 and reveals inner end 300 of actuator 296 through base 236.

Figure 23:
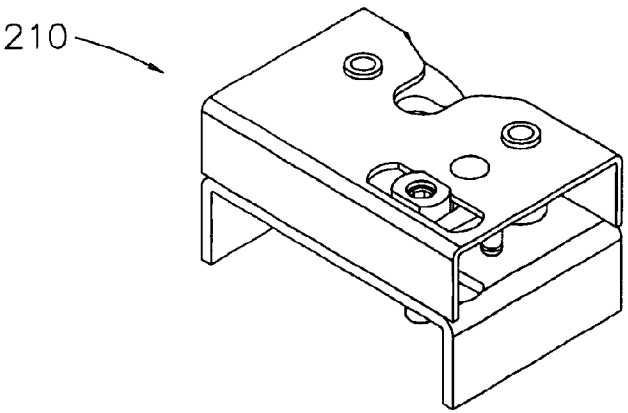
FIG. 23 is a bottom perspective view of the dual action rotary latch of FIG. 20.

FIG. 23 is a bottom perspective view of rotary lock 210 in its locked position.

Figure 24:
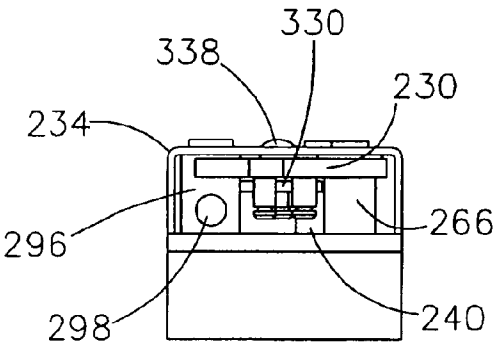
FIG. 24 is a right side view of the dual action rotary latch of FIG. 20.

FIG. 24 is a right side view of the rotary lock 210 without its spring attached and shows actuator rod receiving hole 298 formed through actuator 296. Catch 230, cover 234, strike pivot 240, catch pivot 266, reverser 330 and pivot pin 338 are also shown.

FIG. 25 is a front plan view of rotary lock 210 in its locked position with cover 234 shown in phantom and showing rotary lock 210 with a section of actuator rod 208 attached to actuator 296. Strike 228 is in the closed position relative to opening 238 in cover 234, with finger 252 of strike 228 resting in mouth 310 of catch 230, and with thumb 250 and finger 252 being in a generally horizontal orientation where recess 254 will be captured within opening 238 of cover 234 which will lock locking bar 212 in place and prevent it from being pried out. Finger 288 of catch 230 rests on right side of actuator 296. Reverser 330 is shown pivoted with pivot pin 338 passing through slot 320 of catch 230. Lower end 334 of reverser rides on left side of actuator 296, and riding end 336 rests on pin 340 on catch 230. Spring 308 tends to bias strike 228 and catch 230 together.

Figure 26:
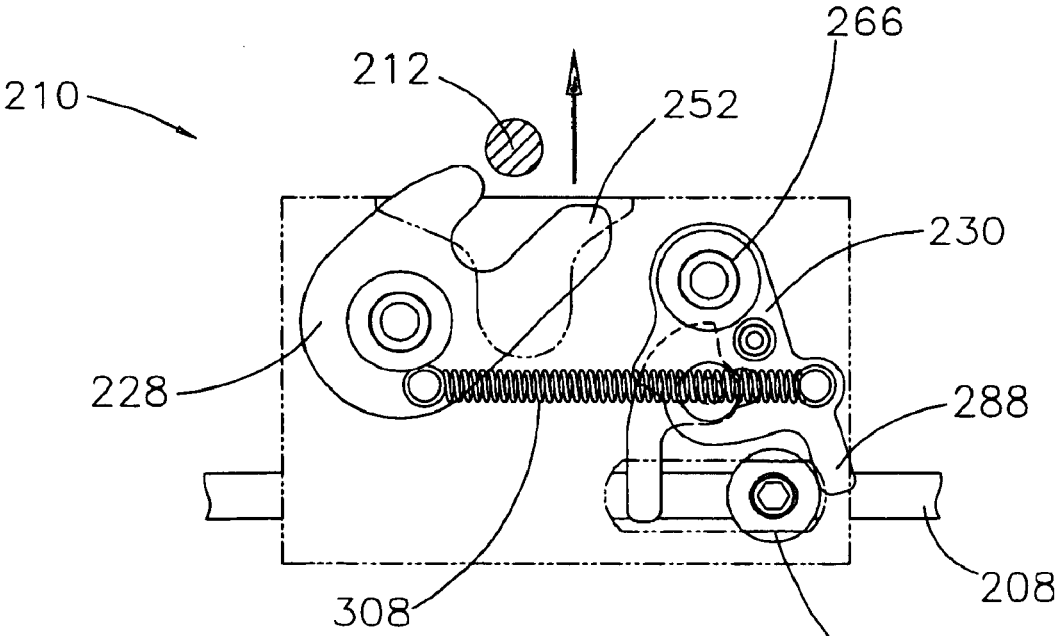
FIG. 26 is a front plan view of the dual action rotary latch of FIG. 20 in its unlocked position showing the actuator rod moved to the right to release the closure bar.

FIG. 26 is a front plan view of rotary lock 210 in its unlocked position with closure bar 212 being released and with actuator rod 208 moved to the right such that its carried actuator 296 will push against finger 288 of catch 230. This action moves catch 230 away from strike 228. The spring tension 308 causes strike 228 to rotate so that its finger 252 points up outside of opening 238 to release locking bar 212.

Figure 27:
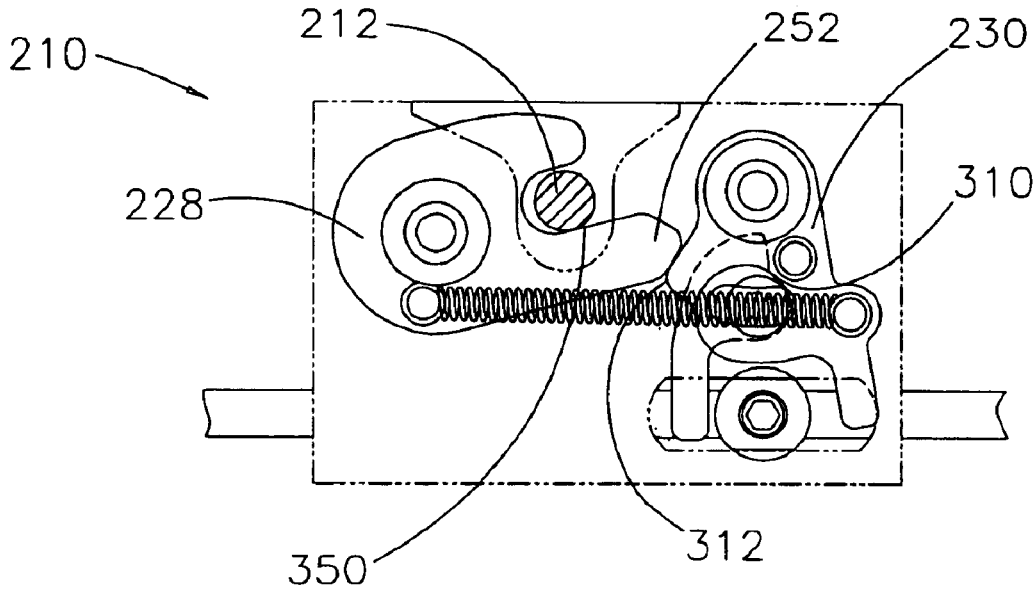
FIG. 27 is a front plan view of the dual action rotary latch of FIG. 20 with the closure bar pushing the strike to its locked position with the catch.

FIG. 27 is a front plan view of rotary lock 210 being moved to its locked position showing outlines of various parts in phantom with closure bar 212 being moved down against an inside edge 350 of finger 252 of strike 228. This action moves catch 230 downwardly and pushes on nose region 312. Once closure bar 212 is pushed all the way down (not shown), it seats in mouth region 310 of catch 230, as shown in FIG. 25.

Figure 28:
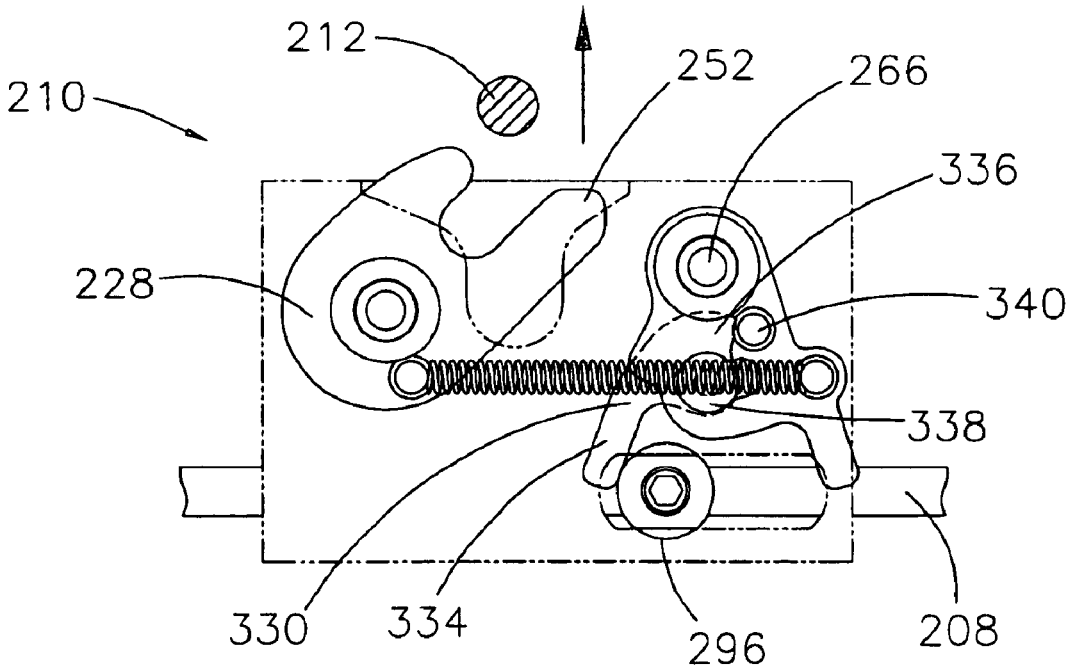
FIG. 28 is a front plan view of the rotary latch of FIG. 20 with the reverser moving the catch away from the strike to open the latch.

FIG. 28 is a front plan view of rotary lock 210 in its unlocked position showing outlines of various parts in phantom with closure bar 212 being released and with actuator rod 208 moved to the left such that its carried actuator 296 will push against lower end 334 of reverser 330. This action causes reverser 330 to rotate about pivot pin 338 and moves riding end 336 so that it pushes on pin 340 on catch 230. This pushing force causes catch 230 to pivot on catch pivot 266 and move away from finger 252 of strike 228. This in turn permits strike 228 to rotate so that its finger 252 points up outside of opening 238 to release locking bar 212.

If either of the two push button locks 206 are unlocked and are activated by being pushed in, this will cause plunger buttons 226 to move beyond terminal end 227 of housing and impinge and push on actuator rod 208. With this invention, the single actuator rod 208 is provided to connect between two or more dual action rotary latches 210 mounted to container 202. Actuator rod 208 is sized to have a length that is preferably slightly less than the distance between plunger buttons 226 located at the ends of push button locks 206 affixed to the container 202. The use of a single actuator bar reduces the number of parts required and simplifies adjustment of the system. Lateral movement of actuator rod 208 to either the right or left direction activates and opens both dual action latches 210 connected thereto, releasing both locking bars 212 from both dual action rotary latches 210 and permitting closure 204 to be opened. The push button lock 206 is designed to permit its push button 226 to be moved inwardly into lock housing 220 by at least a small degree whether or not push button lock 206 is locked. In the unlocked position, when lock button 224 is pushed into lock housing 220, plunger button 226 will be moved beyond a terminal end 227 of lock housing 220 and will push actuator rod 208. However, in the locked position, if lock button 224 is pushed, this movement does not exert enough force on plunger button 226 to cause actuator rod 208 to be moved to open dual action latch rotary 210.

Furthermore, the two push button embodiment of the system can be modified to comprise a single push button lock positioned at one end of the container with a single actuator rod used to connect together two or more latches, with one end of the rod adjacent to the plunger button. In this modified embodiment, single action rotary latches described above can be used. One advantage of this modified embodiment is that only a single push button need be provided and checked to see if locked.

Lastly, while two or more latches can provide greater security, particularly for long containers, a single latch can be used with the locking system that has a single actuator rod with their ends located adjacent to the plunger buttons of the push button locks.

The drawings in the foregoing description are not intended to represent the only form of the invention in regard to the details of its construction and manner of operation. In fact, it will be evident to one skilled in the art that modifications and variations can be made without departing from the spirit and scope of the invention. Although specific terms have been employed, they are intended in a generic and descriptive sense only and not for purposes of limitation.

What is claimed is:

1. A locking system, comprising:

at least two rotary latches, each having a strike, a catch, an actuator, and a reverser;

at least two locks; and an actuator rod connecting the at least two latches, wherein if at least one lock is unlocked, opening the at least one lock connected to one latch will move the actuator rod and open the at least two latches, wherein the catch retains the strike in a locked position when the rotary latch is locked, and the actuator is attached to the actuator rod and movement of the actuator in a first lateral direction moves the catch away from the strike to open the rotary latch, and wherein movement of the actuator in a second lateral direction opposite to the first lateral direction causes the reverser to move the catch away from the strike to open the rotary latch.

2. The locking system of claim 1, wherein the locks are affixed to a container, and locking bars are affixed to a closure for the container, which locking bars lockably engage with the latches.

3. The locking system of claim 1, wherein the locks are push button locks, each having a housing, a push button, and a plunger button that is pushed out of the housing when the push button lock is unlocked and the push button is depressed, which plunger button can be pushed back into the housing when push button lock is both locked and unlocked, and wherein the actuator rod is laterally positioned between the push, button locks, and the latches are opened by movement of the actuator rod in either of two lateral directions between the push button locks.

4. A locking system used on a container with a closure, comprising:

at least one rotary latch having a strike, a catch, a reverser, and an actuator;

two push button locks affixed at opposing sides of a container, each push button lock have a housing, a push button, and a plunger button that is pushed out of the housing when the push button lock is unlocked and the push button is depressed, which plunger button can be pushed back into the housing when push button lock is both locked and unlocked;

a locking bar fixed to the closure; and an actuator rod connected to the at least one latch and laterally positioned between the two plunger buttons of the two push button locks;

wherein if at least one of the two push button locks is unlocked, opening the at least one unlocked push button lock will move the actuator rod in a lateral direction and open the at least one latch, and wherein the catch holds the strike in a locked position capable of capturing the locking bar when the locking bar makes contact with strike and the actuator is attached to the actuator rod and movement of the actuator in a first lateral direction moves the catch away from the strike to cause rotary latch to open, and movement of the actuator in an second lateral direction opposite the first lateral direction causes the reverser to move the catch away from the strike to cause the rotary latch to open.

5. A locking system, comprising:

at least two rotary latches, each having a strike, a catch, an actuator, and a reverser;

at least two locks engaged with the at least two rotary latches;

at least two locking bars;

a single, straight actuator rod connecting the at least two rotary latches, wherein if at least one lock is unlocked, opening the at least one unlocked lock connected to one rotary latch will move the actuator rod and open the at least two rotary latches, wherein the catch holds the strike in a locked position capable of capturing the locking bar when the locking bar makes contact with strike and the actuator connects to the actuator rod and movement of the actuator in a first lateral direction moves the catch away from the strike to cause rotary latch to open, and movement of the actuator in an second lateral direction opposite the first lateral direction causes the reverser to move the catch away from the strike to cause the rotary latch to open.

6. A locking system, comprising:

at least two latches, each having a strike, a catch, an actuator, and a reverser;

at least two locks; and an actuator rod connecting the at least two latches, wherein if at least one lock is unlocked, opening the at least one lock connected to one latch will move the actuator rod and open the at least two latches, wherein the catch retains the strike in a locked position when the rotary latches are locked, and the actuator is attached to the actuator rod and movement of the actuator in a first direction moves the catch away from the strike to open the rotary latches, and wherein movement of the actuator in a second direction opposite to the first direction causes the reverser to move the catch away from the strike to also open the two latches.

7. A locking system, comprising:

at least one latch having a strike, a catch, an actuator, and a reverser;

at least two locks; and an actuator rod connected the actuator of the at least one latch, wherein if at least one lock is unlocked, opening the at least one lock connected to the at least one latch will move the actuator rod and open the at least one latch, wherein the catch retains the strike in a locked position when the latch is locked, and movement of the actuator in a first direction moves the catch away from the strike to open the rotary latch, and wherein movement of the actuator in a second direction opposite to the first direction causes the reverser to move the catch away from the strike to also open the latch.

* * * * *